United States Patent [19]

Huang

[11] 4,298,455

[45] Nov. 3, 1981

[54] VISCOSITY REDUCTION PROCESS

[75] Inventor: Wann-Sheng Huang, Houston, Tex.

[73] Assignee: Texaco Inc., White Plains, N.Y.

[21] Appl. No.: 108,751

[22] Filed: Dec. 31, 1979

[51] Int. Cl.[3] ..... C10G 9/16; C10G 9/00

[52] U.S. Cl. ..... 208/48 AA; 208/106

[58] Field of Search ..... 208/7, 48 AA, 106, 125

[56] References Cited

U.S. PATENT DOCUMENTS 3,030,387 4/1962 Benoit ..... 208/48 AA 3,702,816 11/1972 Buchmann et al. ..... 208/106

OTHER PUBLICATIONS

Nelson, "Petroleum Refinery Engineering", Fourth Ed. (1958), pp. 17 & 18.

*Primary Examiner*—T. M. Tufariello

*Attorney, Agent, or Firm*—Carl G. Ries; Robert A. Kulason; Robert Knox, Jr.

[57] ABSTRACT

The viscosity of a heavy oil such as a crude petroleum oil is reduced by subjecting the oil to a visbreaking treatment in the presence of a chain transfer agent and a free radical initiator.

6 Claims, No Drawings

VISCOSITY REDUCTION PROCESS

This invention relates to the treatment of heavy oils. More particularly, it is concerned with reducing the viscosity of heavy petroleum oils in order to render them more easily pumpable. In one specific embodiment, the invention provides a process for reducing the viscosity of a heavy oil at the production site, thereby permitting the oil to be pumped through pipelines to a refinery.

Broadly, the invention provides a process for subjecting heavy oils of the type described below to a viscosity reducing or visbreaking treatment to promote the breaking of long chain hydrocarbons while minimizing the polymerization of unsaturated hydrocarbons.

Thermal visbreaking processes are well known in the art and have been used to promote the breaking of long chain hydrocarbons. However this is accompanied by some polymerization of the unsaturated hydrocarbons so formed. The polymerized material re-cracks to form additional unsaturated compounds which polymerize further and the saturated hydrocarbons crack to form lighter materials. Ultimately, the repeated polymerization and thermal cracking reactions result in the formation of undesirable tar or coke, in a pitch-like residue, and gas. Conventionally, this pitch-like residue is cut back with a lighter oil so that it can meet fuel oil specifications.

It is an object of this invention to reduce the viscosity of heavy hydrocarbon oils while minimizing the formation of gases and tar. Another object is to convert a heavy, difficulty pumpable oil into one which may be pumped from the production site to a petroleum refinery. These and other objects will be obvious to those skilled in the art from the following disclosure.

According to my invention, there is provided a process for reducing the viscosity of a heavy hydrocarbon oil having an API gravity of less than about 15° which comprises subjecting said oil to a visbreaking treatment in the presence of a free radical initiator and also in the presence of a chain transfer agent.

The heavy hydrocarbon oils which are used as feed to the process of the invention have an API gravity of less than 15° and preferably less than 10°. Examples of such oils are tar sand oil, shale oil, straight run crudes, reduced crudes, liquefied coal fractions, their mixtures and the like.

The visbreaking operation may be any such operation known in the prior art. Although a wide range of visbreaking conditions may be employed, such as a combination of low temperature with a long residence time or conversely a high temperature with a short residence time, it is advantageous to use moderate conditions in conjunction with the free radical initiator and the chain transfer agent to convert the heavy oil to one having a viscosity low enough to be pumpable while minimizing the formation of gas and tar. Visbreaking operations are generally carried out by passing the charge stock through a heating coil and heating the oil to mild cracking temperature. The temperature and the residence time control the amount of thermal cracking or conversion into lower boiling components. Customarily, the temperature will lie between about 800° and 950° F., the residence time at visbreaking temperature between about two minutes and thirty minutes and the pressure between about 100 and 1500 psig.

To minimize the amount of coke or tar and gas formed during a conventional visbreaking process, the invention provides for the visbreaking to be carried out in the presence of a chain transfer agent and a free radical initiator. The free radical initiator reacts with the chain transfer agent to create a free radical which competes with the larger chain hydrocarbons to prevent the formation of tar or coke. Unsaturated hydrocarbons react with the free radical to form saturated hydrocarbons which cannot be polymerized further. With proper control of the quantity of free radical initiator and chain transfer agent added to the oil to be visbroken, and adjustment of the residence time at reaction temperature, the formation of coke can be reduced or even eliminated while obtaining a substantial reduction in the viscosity of the oil. A simple illustration of the mechanism is shown as follows:

(1) $I \rightarrow I.$ (Initiator)

(2) $I. + RSH \rightarrow RS. + IH$ (Initiation)

(3) $RS. + R'CH{=}CHR'' \rightarrow RSCHR'{-}CHR''$. Propagation (4) $RSCHR'{-}CHR''. + RSH \rightarrow RSCHR'{-}CH_2R'' + RS.$ Termination where R, R' and R'' are alkyl groups. The sulfur which is contained in the mercaptan used here as illustrative of a chain transfer agent can easily be removed with the sulfur which is already present in the heavy oil by means of conventional catalytic hydrodesulfurization processes. This method can produce thermally cracked oils without having large molecular residuum. The free radical initiator forces the polymerization process to take the free radical path where it can be terminated by a chain transfer agent. Examples of chain transfer agents are acetone, ethyl methyl ketone, chloroform, carbon tetrachloride, toluene, benzene, carbon tetrabromide, isopropylbenzene, cyclobenzene, cyclohexane and cyclohexanone. Sulfur containing compounds such as thioglycolic acid, o-thiobenzoic acid, β-thiylpropionic acid, methyl mercapto acetate, o-thiomethylbenzoate, ethyl thioglycolate, p-thiocresol and 2-mercapto benzothiazole and thiols or mercaptans such as ethyl, n-butyl, n-amyl, n-hexyl, n-heptyl, n-octyl, n-dodecyl, n-octadecyl, t-butyl, 1-metyl heptyl, t-octyl, α-naphthylmethyl, benzyl, p-methoxylbenzyl, β-ethoxylpropyl, acetyl, benzoyl, o-ethoxylphenyl, phenyl, 1-naphthyl, p-ethoxylphenyl, 2-benzothiazolyl and 2-benzimidazolyl may also be used as chain transfer agents. Examples of free radical initiators are α, α'-azo-bis-isobutyronitrile, benzoyl peroxide, diacetyl peroxide, ammonium persulfate, lead tetraethyl, tridiphenyl methyl, diphenyl picryhydrazyl, n-nitrosoacylarylamine and hydrogen peroxide. The chain transfer agent may be present in an amount between about 0.1 and 5 percent by weight of the heavy oil with 0.1 to 3 percent being preferred. The free radical initiator may be present in an amount between about 0.001 and 1.0 percent with from 0.01 to 0.5 weight percent being preferred.

The following examples are submitted for illustrative purposes only and it should not be construed that the invention is restricted thereto.

EXAMPLE I

In this example, two visbreaking runs were made for comparison purposes, one being carried out under conventional visbreaking conditions and the other being carried out in the presence of a free radical initiator and a chain transfer agent under otherwise substantially identical conditions of time and temperature.

The feed used in this experiment was a Tognazzini crude oil from Cat Canyon, Santa Barbara County, Calif. It had an API gravity of 9.9 degrees and a viscosity of 161 cp at 210° F. which, by means of Braden's correlation, was estimated to be 300,000 cp at 70° F. or 110,000 cp at 80° F. Its composition was 13.5% paraffins, 47.8% aromatics and 38.7% asphaltenes. The experiments were carried out in a 100 cc high pressure bomb made of stainless steel. The bomb was placed in a heating mantle in order to provide an even temperature distribution and purged with nitrogen so that no residual air was present. In run A, 79.2 grams of the crude oil were introduced into the bomb. In Run B, the charge was composed of 81.6 grams of the crude oil, 0.5 gram of ethyl mercaptan and 0.01 gram of $\alpha,\alpha'$-azobisisobutyronitrile. After being loaded, the bomb was sealed and heated to visbreaking temperature as quickly as possible. After approximately 15 minutes at visbreaking temperature the pressure was released and fixed and condensed gases were collected separately from the liquid product. Data on the reaction conditions and product appear below in Table I.

TABLE 1

| Run | Max Temp. °F. | Residence Time at Max Temp. Minutes | Max Press. PSIG | Crude Charged, Grams | Total Gas, Liters | Liquid Condensate, Grams | Liquid Product Grams | Remarks |
|---|---|---|---|---|---|---|---|---|
| A | 830 | 14 | 1000 | 79.2 | 2.77 | 8.5 | 63.2 | Liquid Product Contains Tar* |
| B | 825 | 16 | 525 | 81.6 | 1.02 | 3.4 | 75.9 | No coke formation viscosity 2060 cp at 70° F. |

*consistent viscosity measurement not obtainable due to tars and carbon particles clogging in the Cannon-Fenske viscometer.

Gas analyses are tabulated below:

TABLE 2

| | Run A | Run B |
|---|---|---|
| $CH_4$ | 28.13 | 21.91 |
| $C_2H_6$ | 14.47 | 9.75 |
| $C_3H_8$ | 11.67 | 7.48 |
| i-$C_4H_{10}$ | 2.34 | 1.46 |
| n-$C_4H_{10}$ | 4.88 | 3.36 |
| i-$C_5H_{12}$ | 0 | 0.13 |
| n-$C_5H_{12}$ | 2.37 | 1.95 |
| $C_6H_{14}$ | 1.34 | 1.24 |
| $C_7$+ | 0.03 | 0.24 |
| $H_2$ | 1.20 | 2.30 |
| $C_2H_4$ | 0.04 | 0.14 |
| $C_3H_6$ | 1.23 | 0.53 |
| $C_4H_8$ | 1.96 | 3.48 |
| $H_2S$ | 28.60 | 43.49 |
| $CH_3SH$ | 0 | 0 |
| $C_2H_5SH$ | 0 | 0 |
| $C_5H_{10}$ | 1.35 | 2.21 |
| Neo-$C_5H_{12}$ | 0.39 | 0.33 |

It can be seen from the above that in Run A excessive polymerization took place as evidenced by the formation of tars and it will be noted also that excessive gas production took place. Run B shows that polymerization is inhibited by the use of a chemical compound that reacts with the free radicals present in the crude charge oil more readily than the free radicals react between themselves as would occur in the propagation step of a polymerization process. In the presence of such a chemical compound called a chain transfer agent, polymerization is inhibited so that only lower molecular weight hydrocarbons are produced during the partial cracking step. The higher molecular weight hydrocarbons are cracked at high temperatures before they are repolymerized as they would be in conventional thermal cracking or visbreaking processes.

EXAMPLE II

This example is substantially the same as Run B in Example I except that $CCl_4$ is used as the chain transfer agent and benzoyl peroxide as the free radical initiator. 80.6 g of the oil, together with 0.5 g $CCl_4$ and 0.015 g benzoyl peroxide is charged to the bomb after a nitrogen sweep. After the bomb has been sealed it is then heated rapidly to 830° F. and held at that temperature for 15 minutes. The maximum pressure is 535 psig. Yield-1.13 liters gas, 3.6 g condensate and 74.8 g liquid product. There is no evidence of tar or coke formation and the viscosity of the liquid product at 70° F. is 2040 cp. In both Run A of Example I, and in Example II, the liquid product is pumpable.

Various modifications of the invention as hereinbefore set forth may be made without departing from the spirit and scope thereof and therefore only such limitations should be made as are indicated in the appended claims.

I claim:

1. A process for reducing the viscosity of a heavy hydrocarbon oil having an API gravity of less than about 15° while inhibiting polymer formation which comprises subjecting said oil to a visbreaking treatment in the presence of a halogenated hydrocarbon free radical initiator present in an amount between 0.001 and 1.0% by weight and also in the presence of a chain transfer agent present in an amount between 0.1 and 5.0% by weight of the oil.

2. The process of claim 1 in which the chain transfer agent is carbon tetrachloride.

3. The process of claim 1 in which the free radical initiator is $\alpha$, $\alpha'$-azo-bis-iso-butyronitrile.

4. The process of claim 1 in which the free radical initiator is a peroxide.

5. The process of claim 4 in which the free radical initiator is benzoyl peroxide.

6. The process of claim 1 in which the free-radical initiator is present in an amount between 0.01 and 0.5% by weight.

* * * * *